US009343249B2

(12) United States Patent
Ficek

(10) Patent No.: US 9,343,249 B2
(45) Date of Patent: May 17, 2016

(54) PRESSURE AND ROTATIONALLY ACTUATED CONTROL ELEMENT FOR A MOTOR VEHICLE

(71) Applicant: Leopold Kostal GmbH & Co. KG, Luedenscheid (DE)

(72) Inventor: Wojciech Ficek, Luedenscheid (DE)

(73) Assignee: Leopold Kostal GmbH & Co. KG, Luedenscheid (DE)

( * ) Notice: Subject to any disclaimer, the term of this patent is extended or adjusted under 35 U.S.C. 154(b) by 86 days.

(21) Appl. No.: 14/480,686

(22) Filed: Sep. 9, 2014

(65) Prior Publication Data

US 2014/0374225 A1 Dec. 25, 2014

Related U.S. Application Data

(63) Continuation-in-part of application No. PCT/EP2013/062323, filed on Jun. 14, 2013.

(30) Foreign Application Priority Data

Jun. 19, 2012 (DE) ..... 10 2012 012 172

(51) Int. Cl.
*G05G 1/08* (2006.01)
*G05G 9/047* (2006.01)
(Continued)

(52) U.S. Cl.
CPC ..... *H01H 25/008* (2013.01); *G05G 1/08* (2013.01); *G05G 5/08* (2013.01); *G05G 9/047* (2013.01); *H01H 2221/01* (2013.01); *H01H 2221/03* (2013.01); *H01H 2231/026* (2013.01)

(58) Field of Classification Search
CPC ..... H01H 25/008; G05G 1/08
USPC ..... 200/61.54, 4, 14, 18, 564–567
See application file for complete search history.

(56) References Cited

U.S. PATENT DOCUMENTS 5,584,380 A 12/1996 Naitou
6,218,635 B1 * 4/2001 Shigemoto ..... H01H 25/008 200/11 R (Continued)

FOREIGN PATENT DOCUMENTS

DE 102007038580 A1 2/2009
DE 102011011299 A1 8/2011

OTHER PUBLICATIONS

European Patent Office, International Search Report for the corresponding International Application No. PCT/EP2013/062323, mailed Oct. 8, 2013.

(Continued)

*Primary Examiner* — Amy Cohen Johnson
*Assistant Examiner* — Marina Fishman
(74) *Attorney, Agent, or Firm* — Brooks Kushman P.C.

(57) ABSTRACT

A pressure and rotationally actuated control element for a vehicle steering wheel includes a bearing block and an input element. The bearing block is mounted on actuating elements of switching elements. The input element is mounted rotatably on the bearing block. The input element transmits a rotational actuation to a code disk and an actuating pressure on the input element actuates at least one of the switching elements. The bearing block forms two swivel pins perpendicular to the axis of rotation of the input element and which are supported by the actuating elements of switching elements. The bearing block has a stop element between the swivel pins which limits the path of actuation of the input element by an actuating pressure.

14 Claims, 7 Drawing Sheets

(51) Int. Cl.
*G05G 5/08* (2006.01)
*H01H 25/00* (2006.01)

(56) References Cited

U.S. PATENT DOCUMENTS 6,967,293 B1 11/2005 Chen et al.
9,190,228 B2 * 11/2015 Bloeink ..... G05G 1/08 200/61.54
2006/0071489 A1 4/2006 Bricaud et al.
2007/0120325 A1 5/2007 Miyoshi et al.
2014/0034461 A1 * 2/2014 Bloeink ..... G05G 1/08 200/61.54

OTHER PUBLICATIONS

The International Bureau of WIPO, International Preliminary Report on Patentability for corresponding PCT/EP2013/062323 mailed Dec. 23, 2014.

* cited by examiner

PRESSURE AND ROTATIONALLY ACTUATED CONTROL ELEMENT FOR A MOTOR VEHICLE

CROSS-REFERENCE TO RELATED APPLICATIONS

This application is a continuation-in-part of International Application No. PCT/EP2013/062323, published in German, with an International filing date of Jun. 14, 2013, which claims priority to DE 10 2012 012 172.5, filed Jun. 19, 2012, the disclosures of which are hereby incorporated in their entirety by reference herein.

TECHNICAL FIELD

The present invention relates to a vehicle steering wheel control element that can be actuated by pressure and rotation, the control element having a bearing block mounted on actuating elements of switching elements and a roller-type input elements mounted rotationally in the bearing block, the input element transmits a rotational actuation to a code disk that cooperates with a sensor and pressure actuation of the input element actuates at least one of the switching elements.

BACKGROUND

DE 10 2007 038 580 A1 describes such a control element. The control element is supported on two actuating elements. The actuating elements are implemented as switch domes of a dome pressure sensitive mat. When pressure is applied to the middle of the control element, both switch domes collaborate so that both of two switching elements belonging to the switch domes actuate. The bearing block can be tipped slightly by applying an off-center pressure to the input element, whereby both of the switching elements can also be actuated separately from one another.

However, actuation of an individual switching element is not precise. When the actuating pressure does not take place sufficiently off-center or with too large an application of force, it is not clear whether one or both switching elements have been actuated concurrently, whereby unintended switching functions may be produced. This is even more valid since such operating elements are typically blindly actuated such as when arranged on a vehicle steering wheel.

SUMMARY

An object of the present invention is a pressure and rotationally actuated control element having two pressure actuated functions that can be securely switched individually.

In carrying out at least one of the above and other objects, the present invention provides a pressure and rotationally actuated control element. The control element includes a bearing block and an input element. The bearing block is aligned along a longitudinal axis and is displaceable at each of two ends. The bearing block includes two swivel pins. The swivel pins are spaced apart along the longitudinal axis, extend perpendicular to the longitudinal axis, and are mounted on actuating elements of switching elements. The input element is rotatably mounted on the bearing block to rotate about the longitudinal axis. Rotational actuation of the input element is transmitted to a code disk. The input element with the bearing block displace in response to an actuating pressure on the input element along the longitudinal axis at either end of the bearing block to thereby cause a swivel pin to act on an actuating element to actuate a switching element.

The bearing block further has a stop element between the swivel pins. The stop element limits displacement of the input element with the bearing block in response to an actuating pressure on the input element along the longitudinal axis in the middle between the ends of the bearing block.

Further, in carrying out at least one of the above and other objects, the present invention provides a pressure and rotationally actuated control element for a vehicle. This control element includes a bearing block and a roller-shaped input element. The bearing block is mounted on actuating elements of switching elements. The input element is mounted rotatably on the bearing block. The input element transmits a rotational actuation to a code disk and an actuating pressure on the input element actuates at least one of the switching elements. The bearing block forms two swivel pins perpendicular to the axis of rotation of the input element and which are supported by the actuating elements of switching elements. The bearing block has at least one stop element between the swivel pins which limits the path of actuation of the input element by an actuating pressure.

Embodiments of the present invention are directed to a pressure and rotationally actuated control element for a vehicle. The control element may be for a vehicle steering wheel. The control element includes a roll-type input element and a bearing block. The input element is rotatably mounted on the bearing block. The input element transmits a rotational actuating movement to a code disk which cooperates with a sensor. The bearing block is mounted on actuation elements of switching elements. At least one of the switching elements actuates in response to actuation pressure applied to the input element. The bearing block forms two swivel pins (i.e., pivot axes). The swivel pins extend perpendicular to the axis of rotation of the input element and rest on the actuation elements. The bearing block has at least one molded-on stop element between the swivel pins. The stop element limits the actuation path of the input element when actuation pressure is applied to the input element. Two pressure-actuated switching functions which cannot be jointly actuated are associated with the control element.

In embodiments of the present invention, the bearing block has two swivel pins perpendicular to the axis of rotation of the input element. The swivel pins are supported on actuating elements of switching elements. The bearing block has at least one stop element between the swivel pins. The stop element limits the path of actuation of the input element when actuating pressure is applied to the input element. The stop element may be integrally molded onto the bearing block between the swivel pins.

A swivel pin lying respectively under an actuating point can be displaced vertically against the actuating elements of the switching elements by a pressure applied to the right or left end sections of the input element, whereby the switching elements trigger switching functions.

The swivel pin lying on the side of the input element not subjected to pressure does not experience a large enough force to actuate associated switching elements. Thereby, this swivel pin acts simply as a pivot axis about which the bearing block pivots along with the input element attached to the bearing block.

The stop element on the bearing block between the swivel pins functions to limit the displacement path of the input element when a pressure is applied to one side of the input element. The stop element limits the displacement of the input element such that no force is able to build up that is sufficient to actuate the switching elements on the non-actuated side of the stop element.

In addition, the stop element performs the function of limiting the actuation path of the input element when a pressure is applied to the middle of the input element. In this case, the stop element limits the actuation path of the input element such that none of the switching elements underneath the swivel pins are actuated. This assures that an application of pressure by the input element always triggers at most one of two possible switching functions.

The mounting of the input element on a bearing block having two integrally molded swivel pins has the advantage that an application of pressure by an end section of the input element does not cause the unactuated end section of the input element to rock back and forth.

The above features, and other features and advantages of control elements in accordance with embodiments of the present invention are readily apparent from the following detailed description thereof when taken in connection with the accompanying drawings.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Referring now to FIGS. 1-7, a control element in accordance with an embodiment of the present invention is shown. The control element can be actuated by pressure and rotation. The control element may be for a steering wheel of a vehicle. The control element generally includes a roll-type input element 12 and a bearing block 8 in which the input element is rotatably mounted on the bearing block.

Figure 1:
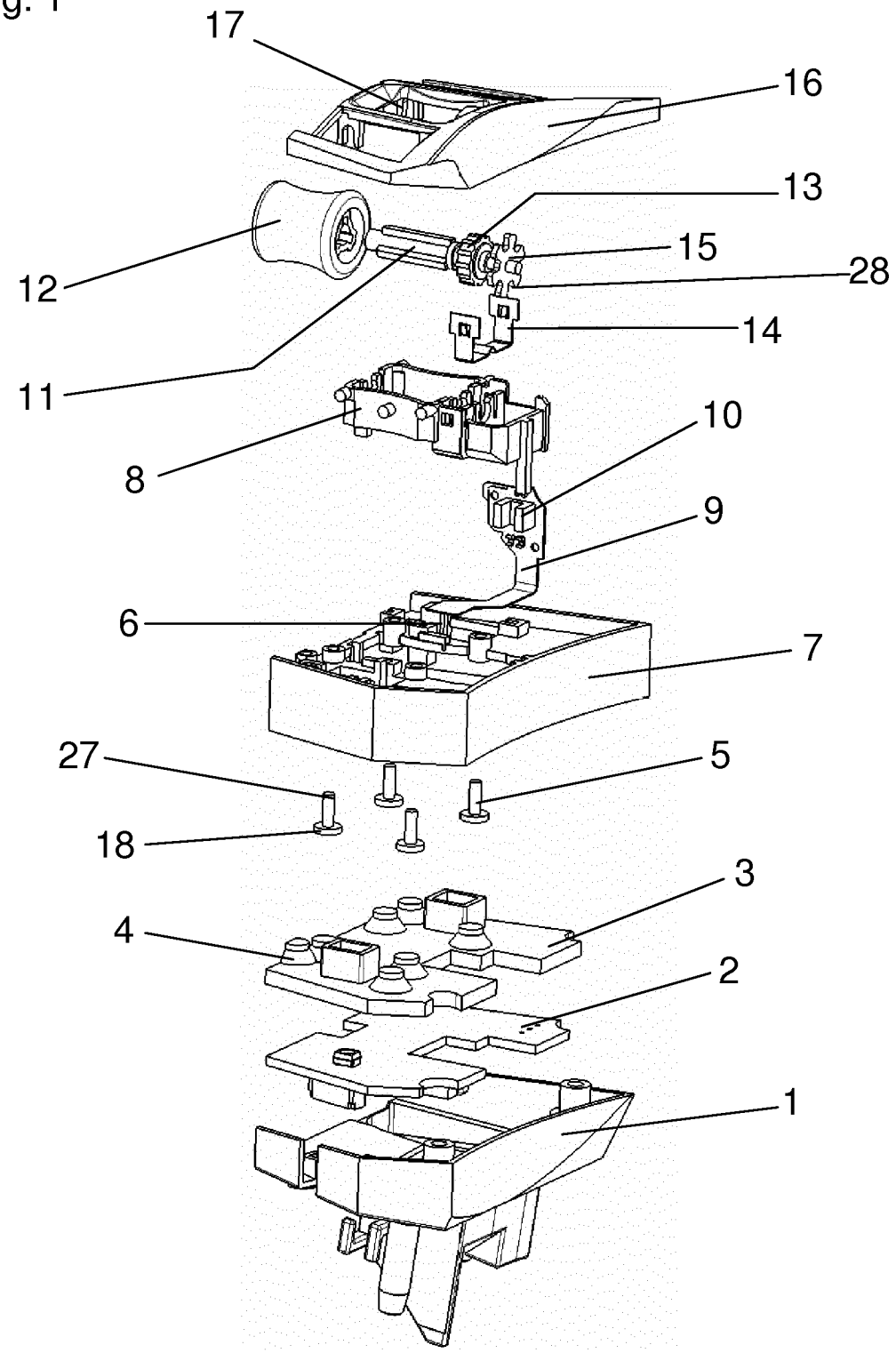
FIG. 1 illustrates an exploded view of a control element in accordance with an embodiment of the present invention.
Figure 2:
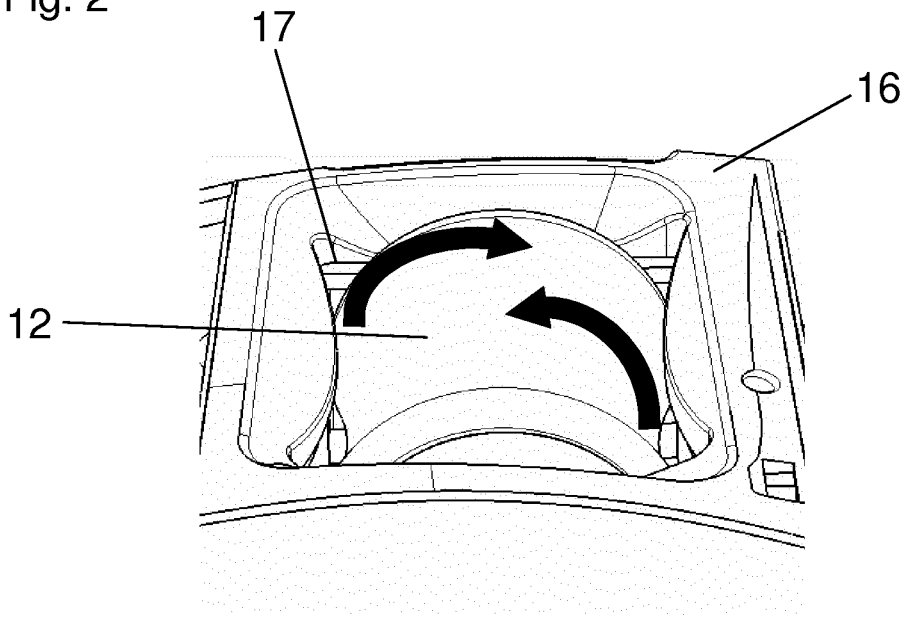
FIG. 2 illustrates a view of rotational actuation of the control element.
Figure 3:
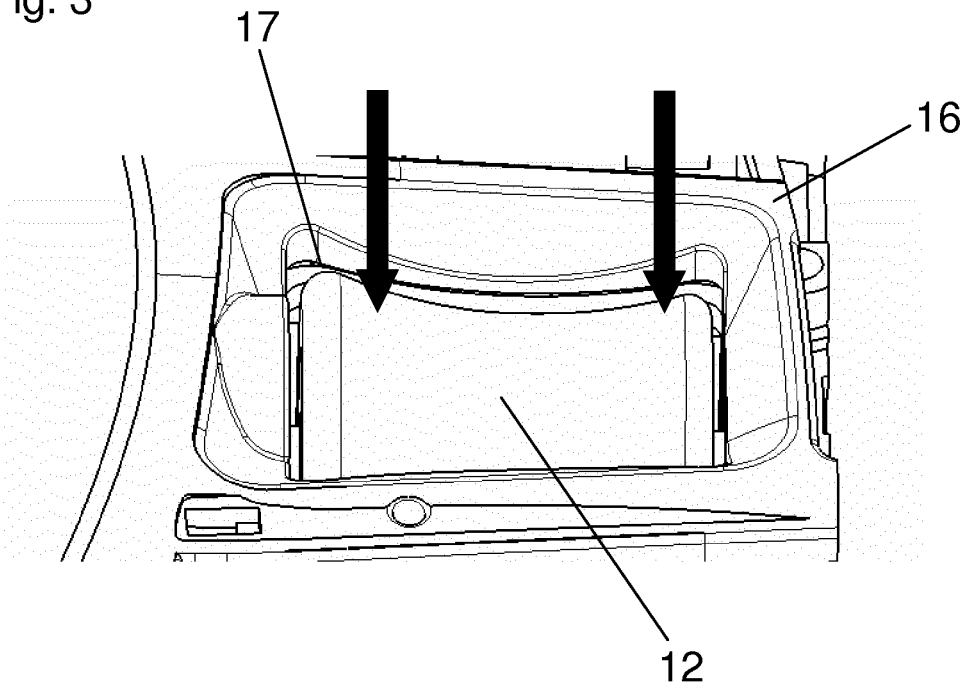
FIG. 3 illustrates a view of pressure actuation of the control element.
Figure 4:
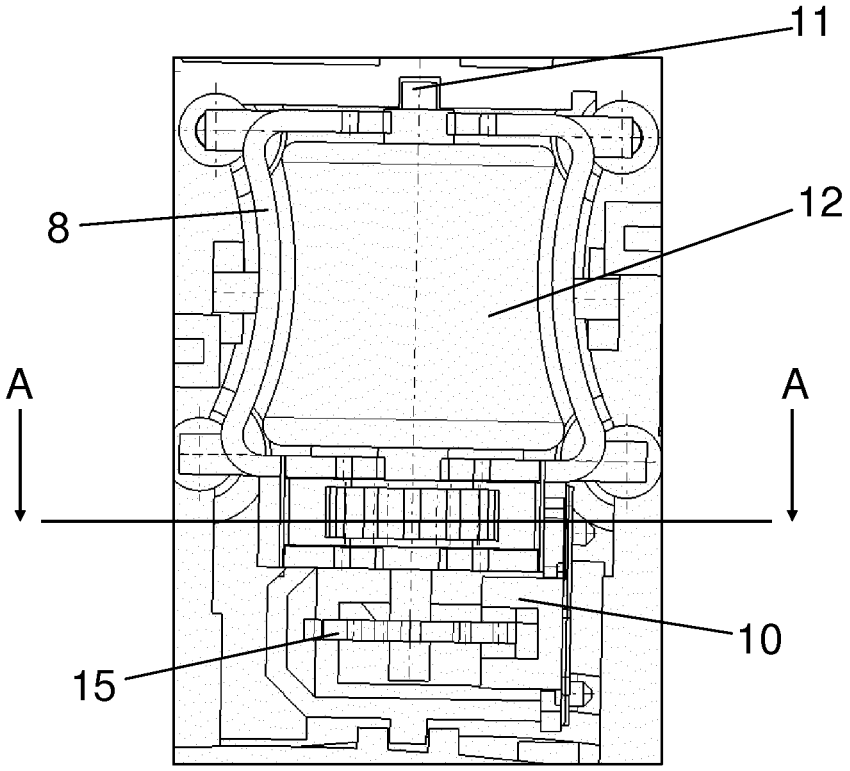
FIG. 4 illustrates a plan view of the control element with the housing cover removed showing the input element arranged on the bearing block.
Figure 5:
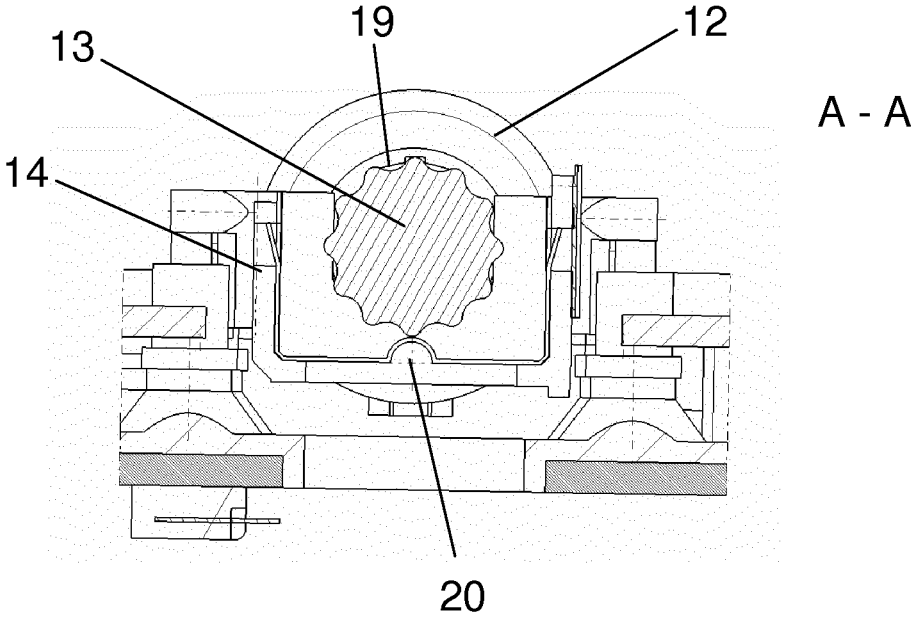
FIG. 5 illustrates a sectional view of the control element through the cross-section axis A-A of FIG. 4.
Figure 6:
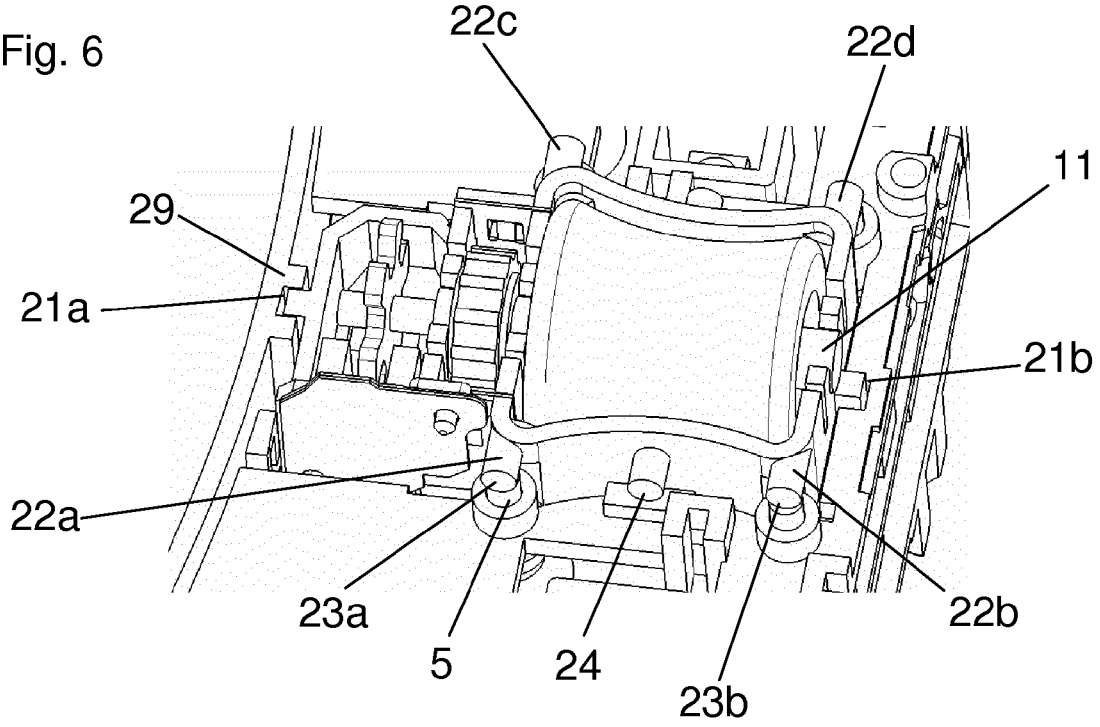
FIG. 6 illustrates a view of the input element and the bearing block of the control element.
Figure 7:
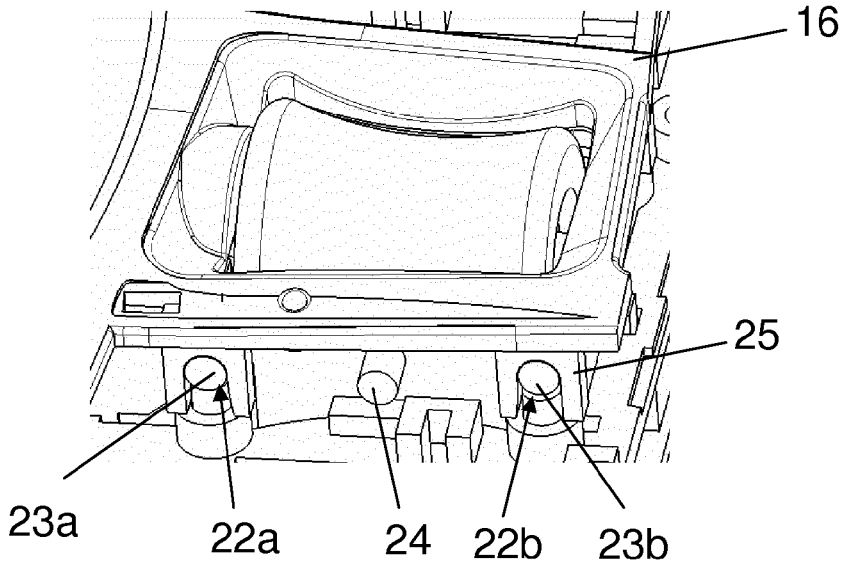
FIG. 7 illustrates another view of the input element and the bearing block of the control element.

FIG. 1 illustrates an exploded view of the control element. FIGS. 2 and 3 illustrate respective views of rotational actuation and pressure actuation of the control element. FIG. 4 illustrates a plan view of the control element showing input element 12 arranged on bearing block 8. FIG. 5 illustrates a sectional view of the control element through the cross-section axis A-A of FIG. 4. FIGS. 6 and 7 illustrate views of input element 12 and bearing block 8 of the control element.

As shown in FIG. 1, in this embodiment the control element further includes a switch assembly. The switch assembly includes a substrate 2 arranged in a housing 1 of the control element. Substrate 2, for example, can be a printed circuit board or a ceramic mounting plate. Substrate 2 supports a plurality of electrical traces (not shown). The switch assembly further includes a dome pressure sensitive mat 3 having switch domes 4. Dome mat 3 is supported on substrate 2. The electrical traces of substrate 2 can be electrically connected to one another by switch domes 4 of dome mat 3. Thus, switch domes 4 form the switching elements. The switching elements can be actuated respectively by pressure on switch domes 4.

As further shown in FIG. 1, the switch assembly further includes a plate-like support 7 having switch plungers 5. Switch plungers 5 are configured to provide actuating pressure to corresponding ones of switch domes 4. Thus, switch plungers 5 form the actuating elements for the switching elements. Switch plungers 5 are mounted movably in guide bushings 6 of plate-like support 7. Guide bushings 6 are integrally molded on plate-like support 7. Each switch plunger 5 has a pin-like section 27 and a plateau-like broadening 18 on an end section of the switch plunger. Pin-like sections 27 of switch plungers 5 are respectively inserted into guide bushings 6 and pass through plate-like support 7 to the upper side of the support. Broadenings 18 at the end section of switch plungers 5 lie on respective switch domes 4 of dome mat 3.

As noted above, the control element includes roller-shaped input element 12 and bearing block 8 in which the input element is rotatably mounted on the bearing block. Bearing block 8 is pivotally arranged on the upper side of plate-like support 7.

Input element 12 is arranged on a shaft 11. Input element 12 and shaft 11 are connected in a rotationally fixed manner together. Shaft 11 is rotatably mounted on bearing block 8. A disk-shaped latching element 13 and a code disk 15 are also connected to shaft 11 in a rotationally fixed manner with the shaft. Latching element 13 and code disk are connected to an end of shaft 11 away from input element 12.

A sensor mechanism is associated with code disk 15. The sensor mechanism acquires the rotational position of code disk 15 preferentially through an optoelectronic or magnetic measurement procedure, such as a Hall-effect sensor. The sensor mechanism can be designed as a slip ring switch. In this case, code disk 15 is formed as a printed circuit board or foil having contact areas. In the embodiment as shown in FIG. 1, the sensor mechanism includes a sensor 10, which is shown for example as a forked light barrier. Sensor 10 detects incisions 28 of code disk 15. Incisions 28 are formed periodically at angles in the radial direction in code disk 15. An evaluation circuit can determine the respective angular position of input element 12 from the number of interruptions of sensor 10 resulting from a rotation of code disk 15. Sensor 10 may have a plurality of optical sensor elements from which response sequence the direction of rotation of code disk 15 can be determined.

The electrical connection of sensor 10 occurs through a flexible circuit foil 9. Circuit foil 9 can be connected electrically, for example, with substrate 2 or an electric plug-in connector on housing 1. Sensor 10 for acquiring a rotational actuation at bearing block 8 enables a simple design for the rotational sensor since the relative arrangement of code disk 15 and sensor 10 is not changed by motion of bearing block 8 when pressure is applied to input element 12.

A latching spring 14 is arranged on bearing block 8. Latching spring 14 cooperates with latching element 13 on shaft 11. A housing cover 16 closes over housing 1. Housing cover 16 includes a recess 17. Input element can be pressure and rotationally actuated through recess 17.

The possibilities for actuating input element 12 are shown schematically by arrows in FIGS. 2 and 3. In particular, rotational actuation of input element 12 is shown in FIG. 2 and pressure actuation of input element 12 is shown in FIG. 3. Input element 12 is roller-shaped and is formed as a rotationally symmetric body. The cross-sectional area of input element 12 along its symmetry axis can either be constant (circular cylinder) or can vary. A portion of the outer surface of input element 12 at any given time is accessible from the outside through recess 17 of housing cover 16. The axis of symmetry of input element 12 is also its axis of rotation and coincides with the longitudinal axis of shaft 11. Input element 12 is thereby unlimited in its rotation in both directions about its axis of symmetry as long as no end stops are provided to limit the rotation.

As indicated in FIG. 3, two switching functions can be triggered by actuating pressure on the end sections of input element 12. However, only one of the two pressure switching functions can be triggered at a time and any simultaneous actuation of both pressure switching functions, even inadvertently, is excluded.

With reference to FIG. 4, which illustrates a plan view of the control element without housing cover 16 showing input element 12 arranged on bearing block 8, rotational actuations of input element 12 are transmitted through shaft 11 to code disk 15. Code disk 15 interrupts the light beam at regular angular intervals of forked light barrier 10 that functions as the rotational position sensor. For example, the rotational direction of input element 12 can also be determined by a two-beam design of sensor 10 along with the amount of rotation.

With reference to FIG. 5, which illustrates a sectional view of the control element through the cross-section axis A-A of FIG. 4, latching spring 14 arranged on bearing block 8 includes detent 20. Detent 20 is integrally molded on latching spring 14. As noted above, latching spring 14 cooperates with latching element 13 on shaft 11. In particular, detent 20 of latching spring 14 cooperates with shaft-like outer contour 19 of latching element 13. Through this cooperation the rotational actuation of input element 12 takes place between haptically differentiable latching positions.

With reference to FIGS. 6 and 7, which show views of input element 12 arranged on bearing block 8, bearing block 8 is pivotably arranged on plate-like support 7. Bearing block 8 is aligned with the longitudinal axis of shaft 11 at two bearing points 21*a*, 21*b*. Bearing block 8 can thereby be vertically displaced or rotated in guide grooves 29 against support 7.

Bearing block 8 includes four stub shafts 22*a*, 22*b*, 22*c*, 22*d*. Stub shafts 22*a*, 22*b*, 22*c*, 22*d* extend from bearing block 8 perpendicular to the longitudinal axis of shaft 11. Stub shafts 22*a*, 22*b*, 22*c*, 22*d* are integrally molded on bearing block 8. Stub shafts 22*a*, 22*b*, 22*c*, 22*d* bear on the upper end section of corresponding switch plungers 5. Stub shafts 22*a*, 22*c* are aligned with respect to one another and thereby form a first swivel pin 23*a* (i.e., a first pivot axis). Similarly, stub shafts 22*b*, 22*d* are aligned with respect to one another and thereby form a second swivel pin 23*b* (i.e., a second pivot axis).

Bearing block 8 further includes a stop pin 24. Stop pin 24 extends between swivel pins 23*a*, 23*b* on both longitudinal sides of bearing block 8 as the stop element. Stop pin 24 is integrally molded on bearing block 8.

When housing cover 16 is assembled as shown in FIG. 7, stub shafts 22*a*, 22*b* of swivel pins 23*a*, 23*b* are mounted in respective guides 25, which stabilize the direction of motion of swivel pins 23*a*, 23*b*.

Referring now to FIGS. 8, 9, 10, and 11, which illustrate respective cross-sectional views of the control element, the pivoting actions of input element 12 and the switching actions they trigger will be explained. As described with reference to FIG. 6, swivel pins 23*a*, 23*b* are formed by stub shafts 22*a*, 22*c* and 22*b*, 22*d*, respectively. Swivel pin 23*a* is mounted on two switch plungers 5 and switch plungers 5 act accordingly on two switch domes 4, respectively. Similarly, swivel pin 23*b* is mounted on two other switch plungers 5 and these switch plungers 5 act accordingly on two other switch domes 4, respectively. In FIGS. 8, 9, 10, and 11, only a single switch plunger 5*a* or 5*b* and correspondingly only one associated switch dome 4*a* or 4*b* is shown. Switch plungers 5*a*, 5*b* and switch domes 4*a*, 4*b* shown in FIGS. 8, 9, 10, and 11 thus represent pairs of switch plungers and switch domes that are actuated together.

Figure 8:
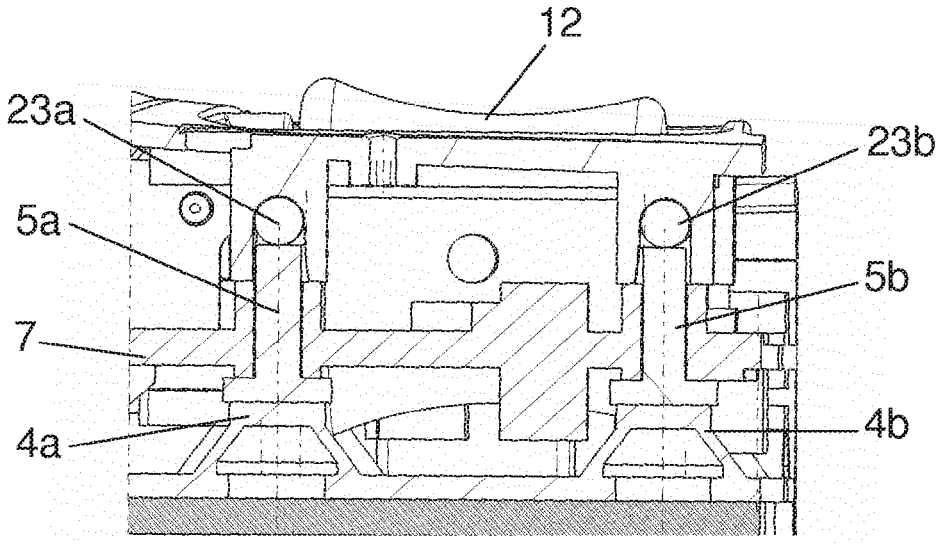
FIG. 8 illustrates a cross-sectional view of the control element with no pressure actuation on the input element.

In FIG. 8, no actuating pressure is on input element 12. In this case, input element 12, swivel pins 23*a*, 23*b*, and switch plungers 5*a*, 5*b* are located in their initial positions. None of switch domes 4*a*, 4*b* are actuated and thus no pressure switching function is triggered.

Figure 9:
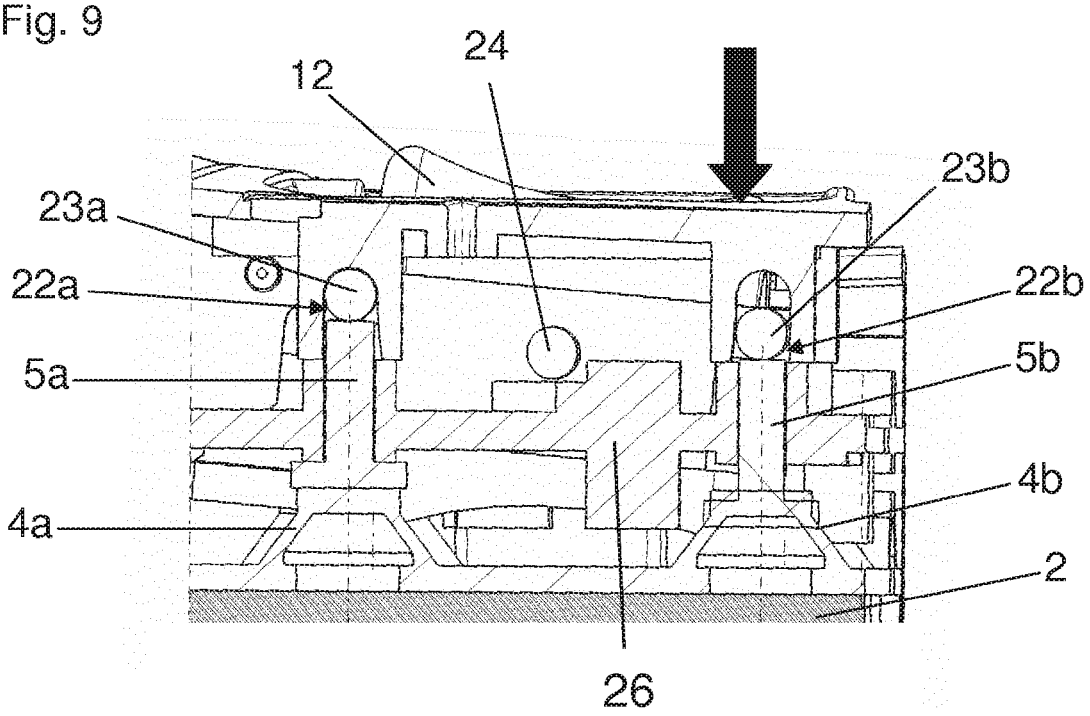
FIG. 9 illustrates a cross-sectional view of the control element with pressure actuation on the right side of the input element.

In FIG. 9, pressure actuation is on the right side of input element 12 as indicated by the arrow therein. In this case, stub shaft 22*b* of right swivel pin 23*b* presses against the corresponding switch plunger 5*b*. Switch plunger 5*b* transmits this force to switch dome 4*b* that lies below switch plunger 5*b*. Switch dome 4*b* thereby collapses and closes the switch contact on switch substrate 2.

The pivoting action of input element 12 or bearing block 8 to which it is connected is produced about stub shaft 22*a* of left swivel pin 23*a*. Due to the lever action that results from the distance to the actuating points, left switch plunger 5*a* experiences little or no vertical displacement. The respective switch dome 4*a* is thereby not compressed and thus does not trigger a switching function. The path of actuation of left switch plunger 5*a* is also restricted because stop pins 24 of bearing block 8 strike end stops 26 on support 7 after a prescribed path of actuation. Thus stop pins 24 themselves are now converted into a rotating bearing through the direction of the force acting on stub shaft 23*a* and is now directed away from switch plungers 5*a*.

Figure 10:
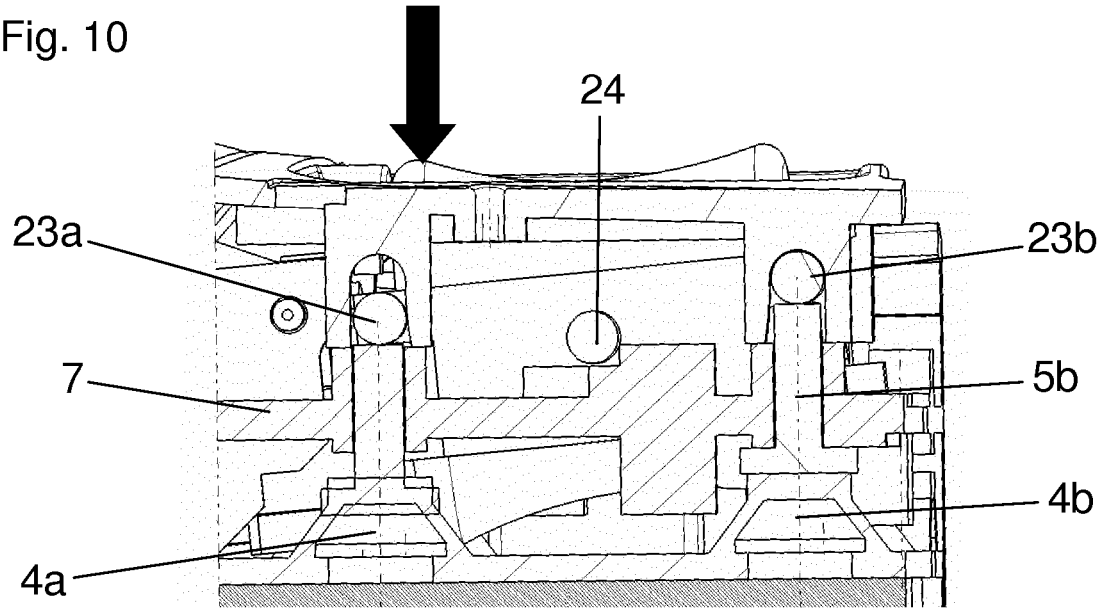
FIG. 10 illustrates a cross-sectional view of the control element with pressure actuation on the left side of the input element.

In FIG. 10, pressure actuation is on the left side of input element 12 as indicated by the arrow therein. In this case, stub shaft 22*a* of left swivel pin 23*a* presses against the corresponding switch plunger 5*a*. Switch plunger 5*a* transmits this force to switch dome 4*a* that lies below switch plunger 5*a*. Switch dome 4*a* thereby collapses and closes the switch contact on switch substrate 2. As such, opposite to the position shown in FIG. 9, in response to an actuating pressure on the left side of input element 12 the input element is pivoted about right swivel pin 23*b*, whereby the stub shaft of swivel pin 23*a* moves downwardly and switch plunger 5*a* presses against switch dome 4*a*.

Figure 11:
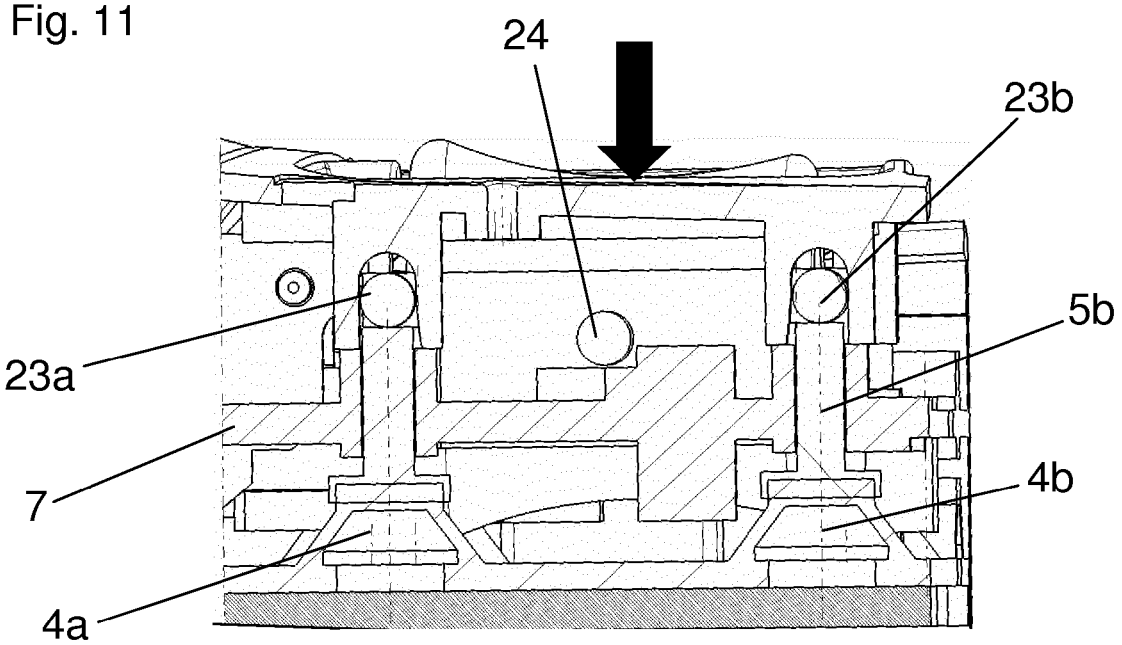
FIG. 11 illustrates a cross-sectional view of the control element with pressure actuation on the middle portion of the input element.

In FIG. 11, a pressure actuation acts on the middle portion of input element 12 as indicated by the arrow therein. In this case, due to the symmetry of the applied force, both swivel pins 23*a*, 23*b* are displaced vertically in parallel and press to some extent together on switch plungers 5*a*, 5*b*. The switch plungers 5*a*, 5*b* act as the actuating elements together on all the associated switch domes 4*a*, 4*b*. The vertical displacement ends when stop pin 24 impinges on end stop 26. As is shown in FIG. 11, the path of actuation of switch plungers 5*a*, 5*b* is too small to cause switch domes 4*a*, 4*b* to collapse without an additional pivoting motion of input element 12 or bearing block 8. An actuating pressure in the middle of input element 12 thus fails to trigger a switching function.

Figure 12:
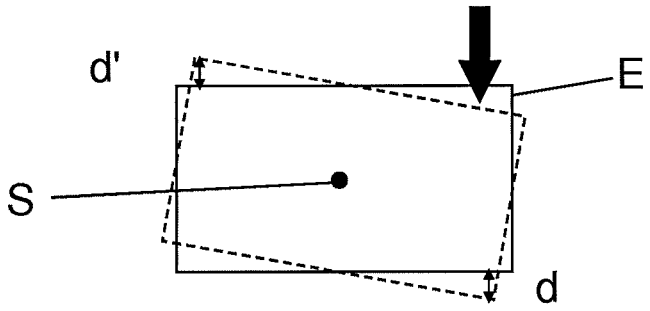
FIG. 12 illustrates a schematic view of the pivoting of a middle-mounted input element.
Figure 13:
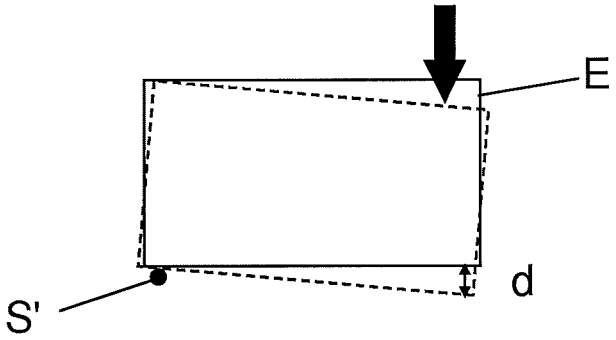
FIG. 13 illustrates a schematic view of the pivoting of the input element of the control element in which the input element is mounted in accordance with embodiments of the present invention.

Referring now to FIGS. 12 and 13, advantageous features of input element 12 being able to pivot about two pivot axes (i.e., swivel pins 23*a*, 23*b*) will be described in further detail. FIG. 12 illustrates a schematic view of the pivoting of a middle-mounted input element in accordance with standard techniques whereas FIG. 13 illustrates a schematic view of the pivoting of input element 12 of the control element in accordance with embodiments of the present invention.

An input element E is depicted in each of FIGS. 12 and 13 schematically as a rectangle in a side view. The initial position of the input element E is depicted with solid lines and the pivoted position of the input element E is depicted with dashed lines. The input element E in FIG. 12 has a pivot axis S. The input element E (e.g., input element 12) in FIG. 13 has a pivot axis S'. The position of pivot axes S and S', which lie perpendicular to the plane of the drawing, is respectively indicated by a point.

FIG. 12 shows the pivoting of input element E about a centrally arranged pivot axis S. A vertical displacement d produced by an actuating pressure on the end section of input element E leads to an upward pivoting by an equal amount d' on the opposite top surface of the input element. Input element E thereby acts like a rocker switch. Such a switch motion and the resulting haptics are often not desirable.

FIG. 13 shows the pivoting of input element E (e.g., input element 12) about a pivot axis S' located on the lower edge. A vertical displacement d produced by an actuating pressure on the end section of input element E produces a negligible deflection on the opposite upper side for the same vertical deflection. The haptic feedback thus corresponds to pressing a key, and in the case of an input element 12 having two pivot axes 23*a*, 23*b*, the characteristics of two neighboring keys, without the coupling by rocking back and forth of the opposite side being immediately detected.

As described, a pressure and rotationally actuated control element in accordance with embodiments of the present invention includes roller-shaped input element 12 and bearing block 8. Input element 12 is rotatably mounted on bearing block 8. Bearing block 8 is mounted on actuation elements 5 of switching elements 4. At least one of switching elements 4 actuates in response to actuation pressure applied to input element 12. Bearing block 8 forms two swivel pins 23*a*, 23*b* (i.e., pivot axes). Swivel pins 23*a*, 23*b* extend perpendicular to the axis of rotation of input element 12 and rest on actuation elements 5. Bearing block 8 has a stop element 24 between swivel pins 23*a*, 23*b*. Stop element 24 limits the actuation path of input element 12 when actuation pressure is applied to input element 12. Two pressure-actuated switching functions which cannot be jointly actuated are associated with the control element.

REFERENCE SYMBOLS

1 housing
2 substrate
3 dome pressure sensitive mat
4 switch dome
4*a*, 4*b* switch dome (pair)
5 switch plunger
5*a*, 5*b* switch plunger (pair)
6 guide bushing
7 support
8 bearing block
9 flexible printed circuit board or foil
10 sensor (forked light barrier)
11 shaft
12 input element
13 latching element
14 latching spring
15 code disk
16 housing cover
17 recess
18 broadening
19 outer contour
20 detent
21*a*, 21*b* bearing points
22*a*, 22*b*, 22*c*, 22*d* stub shaft
23*a*, 23*b* swivel pins (pivot axes)
24 stop pin (stop element)
25 guides
26 end stops
27 dowel-like sections
28 incisions
29 guide grooves
d, d' deflections
E input element
S, S' pivot axes While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A pressure and rotationally actuated control element comprising:

a support having first and second guides and an end stop;

a bearing block displacebly mounted to the support at first and second ends aligned along a longitudinal axis, the bearing block including first and second swivel pins, the swivel pins are spaced apart along the longitudinal axis, extend perpendicular to a rotational axis aligned with the longitudinal axis, and are respectively pivotably supported in the first and second guides of the support, the first swivel pin adjacent to a first actuating element of a first switching element and the second swivel pin adjacent to a second actuating element of a second switching element; and a roller-shaped input element rotatably mounted on the bearing block to rotate about the rotational axis aligned with the longitudinal axis, wherein rotational actuation of the input element is transmitted to a code disk;

wherein the input element with the bearing block pivotably displace relative to the first guide of the support about the first swivel pin in response to an actuating pressure on the input element adjacent the second pin to cause the second swivel pin to displace away from the second guide of the support and towards the second actuating element to actuate the second switching element;

the bearing block further having a stop element between the swivel pins, wherein the stop element engages the end stop of the support in response to further actuating pressure on the input element adjacent the second swivel pin to limit displacement of the first swivel pin towards the first actuating element which would otherwise occur due to the further actuating pressure on the input element adjacent the second swivel pin.

2. The control element of claim 1 wherein:

the switching elements are dome switching contacts.

3. The control element of claim 1 wherein:

the switching elements are micro-switches.

4. The control element of claim 1 wherein:

the switching elements are switch domes of a dome pressure sensitive mat.

5. The control element of claim 4 wherein:

the actuating elements are switch plungers.

6. The control element of claim 1 wherein:

the control element is associated with a steering wheel of a vehicle.

7. The control element of claim 1 wherein:

the control element is associated with a dashboard of a vehicle.

8. A pressure and rotationally actuated control element for a vehicle, the control element comprising:

a support having first and second guides and an end stop;

a bearing block having first and second swivel pins respectively pivotably supported in the first and the second guides of the support, the first swivel pin mounted on a first actuating element of a first switching element and the second swivel pin mounted on a second actuating element of a second switching elemenet; and a roller-shaped input element mounted rotatably on the bearing block, wherein the input element transmits a rotational actuation to a code disk;

wherein the input element and the bearing block pivotably displace relative to the first guide of the support about the first swivel pin in response to an actuating pressure on the input element adjacent the second swivel pin to cause the second swivel pin to displace away from the second guide of the support and towards the second actuating element to actuate the second switching element;

wherein the bearing block further includes at least one stop element between the swivel pins which engages the end stop of the support in response to further actuating pressure on the input element adjacent the second swivel pin to limit displacement of the first swivel pin towards the first actuating element which would otherwise occur due to the further actuating pressure on the input element adjacent the second swivel pin.

9. The control element of claim 8 wherein:

the switching elements are dome switching contacts.

10. The control element of claim 8 wherein:

the switching elements are micro-switches.

11. The control element of claim 8 wherein:

the switching elements arc switch domes of a dome pressure sensitive mat.

12. The control element of claim 11 wherein:

the actuating elements are switch plungers.

13. The control element of claim 8 wherein:

the control element is associated with a steering wheel of a vehicle.

14. The control element of claim 8 wherein:

the at least stop element is integrally molded on the bearing block.

* * * * *